US009422687B2

(12) United States Patent
Reinert

(10) Patent No.: US 9,422,687 B2
(45) Date of Patent: Aug. 23, 2016

(54) FLAT PLATE FOUNDATION SUPPORTS

(71) Applicant: Gary L Reinert, Carnegie, PA (US)

(72) Inventor: Gary L Reinert, Carnegie, PA (US)

( * ) Notice: Subject to any disclaimer, the term of this patent is extended or adjusted under 35 U.S.C. 154(b) by 0 days.

(21) Appl. No.: 14/708,608

(22) Filed: May 11, 2015

(65) Prior Publication Data

US 2016/0024740 A1 Jan. 28, 2016

Related U.S. Application Data

(62) Division of application No. 14/346,656, filed as application No. PCT/US2012/056699 on Sep. 21, 2012, now abandoned.

(60) Provisional application No. 61/671,469, filed on Jul. 13, 2012, provisional application No. 61/671,488, filed on Jul. 13, 2012, provisional application No. 61/537,803, filed on Sep. 22, 2011.

(51) Int. Cl.

| | |
|---|---|
| ***E02D 27/02*** | (2006.01) |
| ***E02D 5/80*** | (2006.01) |
| ***E02D 27/12*** | (2006.01) |
| ***E02D 27/32*** | (2006.01) |
| ***E02D 27/50*** | (2006.01) |

(52) U.S. Cl.

CPC *E02D 27/02* (2013.01); *E02D 5/80* (2013.01); *E02D 27/12* (2013.01); *E02D 27/32* (2013.01); *E02D 27/50* (2013.01)

(58) Field of Classification Search

CPC ..... E02D 5/80; E02D 5/74; E02D 27/12; E02D 27/02; E02D 27/32; E02D 27/50; E04H 12/2269; E04H 12/2215; E04H 12/223

USPC ..... 52/169.9, 155, 156, 158, 159, 164, 165, 52/704, 709

See application file for complete search history.

(56) References Cited

U.S. PATENT DOCUMENTS

| | | | | | |
|---|---|---|---|---|---|
| 2,023,155 | A | * | 12/1935 | Turner | E04H 15/003 135/118 |
| 2,980,124 | A | * | 4/1961 | Atchison | E04H 15/003 135/154 |
| 3,242,623 | A | * | 3/1966 | Brisse | E02D 5/80 52/148 |
| 3,581,436 | A | * | 6/1971 | Basiger | A01G 13/0206 135/87 |
| 3,861,097 | A | * | 1/1975 | Patterson | E02D 5/805 52/160 |
| 4,730,423 | A | * | 3/1988 | Hughes | E04D 13/0335 135/87 |
| 4,882,891 | A | * | 11/1989 | Sero | E02D 5/72 405/229 |
| 4,974,997 | A | * | 12/1990 | Sero | E02D 5/72 405/231 |
| 5,066,168 | A | * | 11/1991 | Holdeman | E02D 7/22 405/245 |

(Continued)

FOREIGN PATENT DOCUMENTS

WO WO 2013044125 3/2013

*Primary Examiner* — James Ference

(74) *Attorney, Agent, or Firm* — Blynn L. Shideler; Krisanne Shideler; BLK Law Group

(57) ABSTRACT

A flat-plate foundation support includes a lower portion extending longitudinally along a central longitudinal axis of the support and adapted for insertion into a ground surface. The lower portion has a plurality of flat plates that are mutually connected along the central longitudinal axis of the support and extend laterally or radially from the central longitudinal axis. The flat plates are beveled and have a sharpened leading edge at a lower end of the lower portion. An upper portion of the support is attached to a top end of the lower portion. The upper portion of the support is attached to a ground supported apparatus to anchor the apparatus to the ground.

9 Claims, 6 Drawing Sheets

(56) References Cited

U.S. PATENT DOCUMENTS 5,322,386 A * 6/1994 Trangsrud ..... E02D 5/80 405/19
5,660,504 A * 8/1997 Reinert, Sr. ..... E02D 7/26 173/184
5,733,068 A 3/1998 Reinert, Sr.
5,873,679 A * 2/1999 Cusimano ..... E04B 1/34347 405/229
5,944,452 A * 8/1999 Reinert, Sr. ..... E02D 7/20 173/184
6,202,369 B1 * 3/2001 Partee ..... E01F 9/0117 248/523
6,272,798 B1 * 8/2001 Cockman ..... E02D 5/801 135/118
6,722,821 B1 * 4/2004 Perko ..... E02D 5/801 405/249
6,866,251 B2 * 3/2005 Rosaen ..... E04H 17/161 256/25
7,003,919 B2 * 2/2006 Riker ..... E04H 12/2269 52/170
7,627,994 B1 * 12/2009 Demirkan ..... E04H 12/2269 248/530
7,780,139 B2 * 8/2010 Markert ..... E04H 12/2261 135/15.1
7,921,616 B2 * 4/2011 Reyneveld ..... E02D 27/42 52/295
8,286,925 B1 * 10/2012 White, Jr. ..... A47G 29/1216 248/156
2002/0088186 A1 * 7/2002 Cusimano ..... E02D 27/50 52/162
2002/0095880 A1 * 7/2002 MacKarvich ..... E04B 1/34352 52/169.12
2003/0140578 A1 * 7/2003 Moreno, Jr. ..... E02D 27/01 52/169.1
2005/0232707 A1 * 10/2005 Reinert ..... E02D 27/42 405/232
2006/0236647 A1 * 10/2006 Fehr ..... E04C 3/30 405/262
2007/0000187 A1 * 1/2007 St. Onge ..... E02D 5/74 52/157
2007/0056226 A1 * 3/2007 Angelo ..... E02D 27/48 52/169.9
2007/0065233 A1 * 3/2007 Collina ..... E02D 5/28 405/232
2008/0282625 A1 * 11/2008 Stahm ..... E02D 5/80 52/163
2009/0038240 A1 * 2/2009 Leonard ..... E04B 1/34352 52/169.9
2009/0133337 A1 * 5/2009 Hill ..... E02D 5/80 52/165
2009/0212177 A1 * 8/2009 Beasley ..... F16M 5/00 248/127
2010/0257794 A1 * 10/2010 Stark ..... E04H 12/2215 52/158
2014/0237913 A1 * 8/2014 Kronz ..... E02D 27/12 52/169.9

* cited by examiner

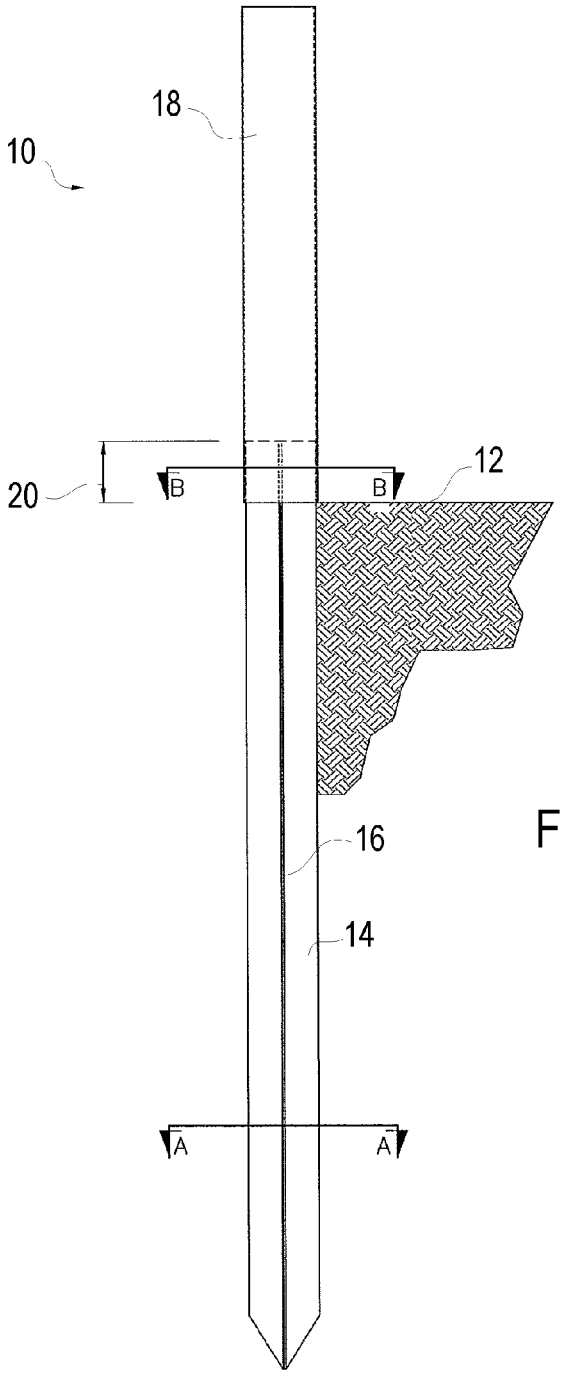
FIG. 1A
FIG. 1B
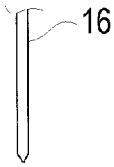
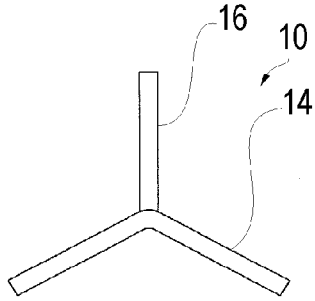
FIG. 2
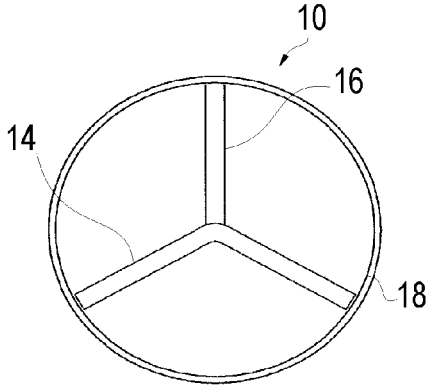
FIG. 3

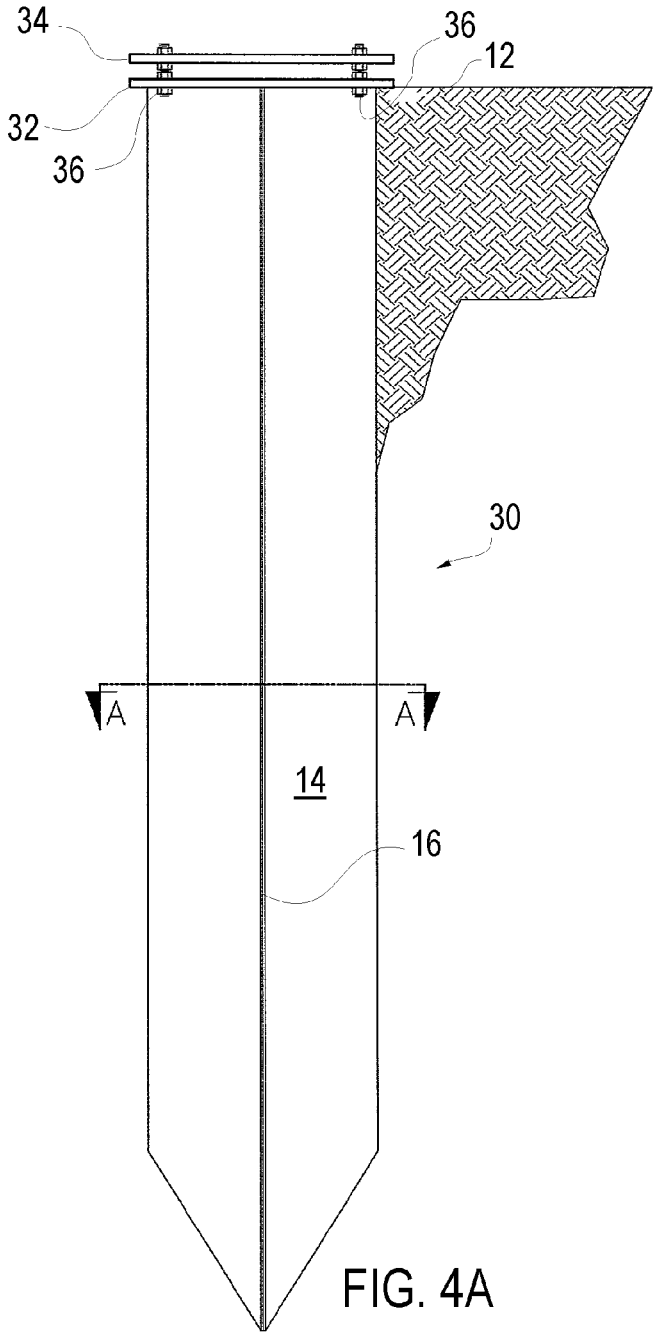
FIG. 4A
FIG. 4B
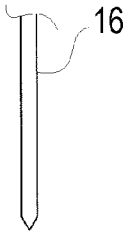

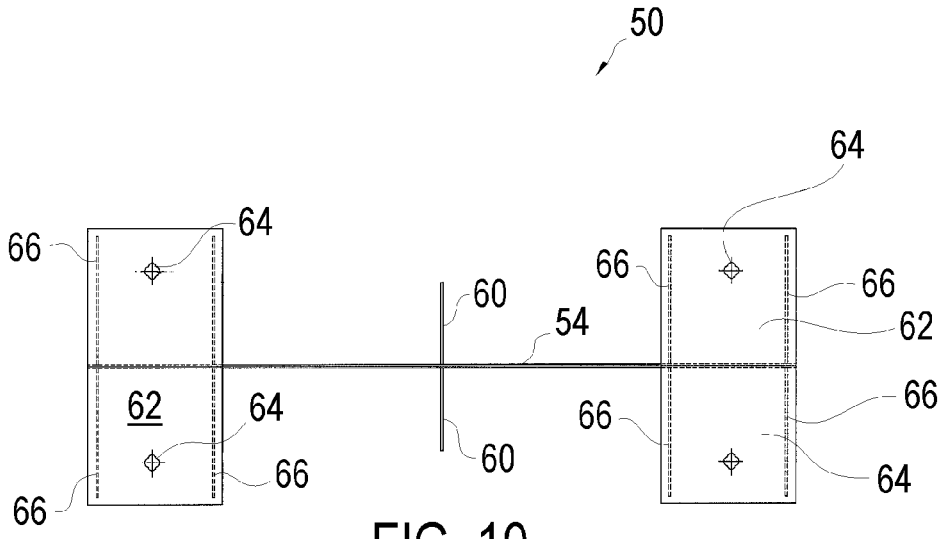
FIG. 10
FIG. 10A
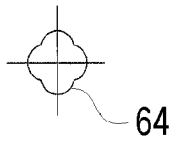

FLAT PLATE FOUNDATION SUPPORTS

RELATED APPLICATIONS

This application is a divisional of U.S. patent application Ser. No. 14/346,656 filed Mar. 21, 2014 entitled "Foundation Apparatus and Method" and which published as U.S. Publication US 2014-0237913 A1 on Aug. 28, 2014 and which publication is incorporated herein by reference in its entirety.

U.S. patent application Ser. No. 14/346,656 is a national stage of International patent application Ser. No. 14/346,656 filed Sep. 21, 2012 entitled "Foundation Apparatus and Method" and which published as International Publication WO 2013/044125 on Mar. 28, 2014 and which publication is incorporated herein by reference in its entirety.

International patent application Ser. No. 14/346,656 claims the benefit of provisional Patent Application Ser. Nos. 61/671,469 and 61/671,488 both filed Jul. 13, 2012 and both entitled "Foundation Apparatus and Method." International patent application Ser. No. 14/346,656 claims the benefit of provisional Patent Application Ser. No. 61/537,803 filed Sep. 22, 2011 entitled "Flat Plate Foundation Supports."

BACKGROUND INFORMATION

1. Field of the invention

The present invention relates to various flat-plate foundation supports that provide a foundation anchor for various ground supported structures. Specifically, the present invention relates to a foundation anchor support that comprises a plurality of flat longitudinally extending plates that are mutually connected along a central longitudinal axis of the support, which are adapted to be inserted beneath a ground surface, and have at least one support member attached to the anchor support above the ground surface.

2. Background Information

The present invention relates to a foundation apparatus, a method of providing structural support, and method of making, using, and installing the foundation apparatus for structural support. For background consider U.S. Pat. No. 4,882,891, which is incorporated herein by reference, which relates to an apparatus and method for installing a structural anchor or foundation in an earthen hole wherein the foundation includes radial vanes for resisting turning moments. For further similar background see U.S. Pat. No. 4,974,997, this is also incorporated herein by reference, and which discloses a hydraulic setting tool assembly that is particularly useful for installing a structural anchor or foundation in an earthen hole.

There remains a need in the art for cost effective easy to install foundations. The foundation of the present invention reduces or eliminates the need for specialized installation equipment such as is the case for drilled foundations. The present invention also substantially eliminates the expenses associated with the handling and disposal of excavation spoils, placing of concrete reinforcing rods, trucking and placement of concrete, and time delay associated with concrete curing before the foundation can be put in service.

SUMMARY OF THE INVENTION

This invention is directed to a flat-plate foundation support which includes a lower portion extending longitudinally along a central longitudinal axis of the support and adapted for insertion into a ground surface. The lower portion has a plurality of flat plates that are mutually connected along the central longitudinal axis of the support and extend laterally or radially from the central longitudinal axis. The flat plates are beveled and have a sharpened leading edge at a lower end of the lower portion. An upper portion of the support is attached to a top end of the lower portion. The upper portion of the support is attached to a ground supported apparatus to anchor the apparatus to the ground.

According to an embodiment of the present invention, the upper portion is a cylindrical pipe disposed over the top end of the lower portion and having an inner surface attached to the individual flat plates, which extend above the ground surface.

According to another embodiment of the present invention, the upper portion is a top plate that is disposed on the top end of the lower portion such that the plate extends across the top edges flat plates of the lower portion, which are disposed flush with the ground surface such that the top plate is disposed on the ground surface.

According to another embodiment of the present invention, the lower portion of the support includes an elongated plate having a center portion that is beveled, with respect to the longitudinal axis of the lower portion, and a bottom portion that is beveled more sharply, with respect to the longitudinal axis. The leading edge of both the center and bottom portions of the elongated plate are sharpened. The lower portion also includes a pair of side plates disposed on either side of the elongated plate and connected to the elongated plate along the central longitudinal axis. The lower end of the side plates is beveled and includes a sharpened leading edge. The length of the side plates along the central longitudinal axis is shorter than the length of the elongated plate such that the side plates are buried in the ground surface while the top end of the elongated plate extends above the ground surface. The upper portion of the support includes a pair of support plates disposed on top of opposing lateral ends of the elongated plate. The support plates may additionally be supported by one or more triangular gussets extending between the elongated plate and the support plate. One structure, such as an A-frame structure, or plural ground supported structures may be anchored according this embodiment.

The features that characterize the present invention are pointed out with particularity in the claims which are part of this disclosure. These and other features of the invention, its operating advantages and the specific objects obtained by its use will be more fully understood from the following detailed description in connection with the attached figures.

BRIEF DESCRIPTION OF THE FIGURES

FIG. 1A is a side view of a flat plate foundation support according to an embodiment of the present invention.

FIG. 1B is an enlarged side view of a single fin of the flat plate foundation support shown in FIG. 1A.

FIG. 2 is a cross-sectional view of the foundation support taken along lines "A-A", shown in FIG. 1A.

FIG. 3 is a cross-sectional view of the foundation support taken along lines "B-B", shown in FIG. 1A FIG. 4A is a side view of a flat plate foundation support according to another embodiment of the present invention.

FIG. 4B is an enlarged side view of a single fin of the flat plate foundation support shown in FIG. 4A.

FIG. 10 is a top plan view of the flat plate foundation of FIG. 8A.

FIG. 10A is an enlarged top plan view of an adjustable mounting hole configuration of the flat plate foundation of FIG. 10.

DESCRIPTION OF THE PREFERRED EMBODIMENTS

Figure 5:
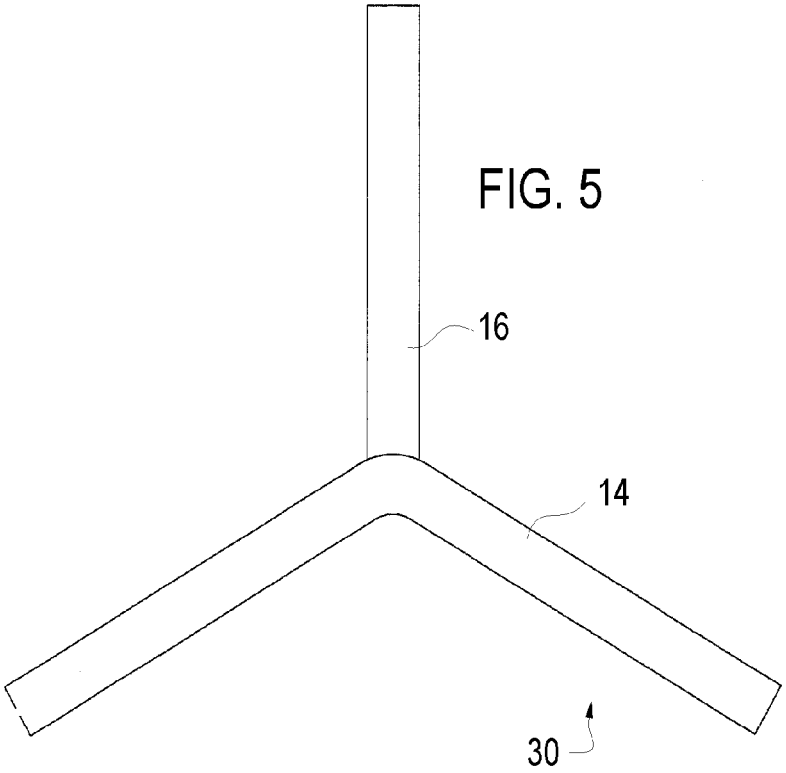
FIG. 5 is a cross-sectional view of the foundation support taken along lines "A-A", shown in FIG. 4A.
Figure 6:
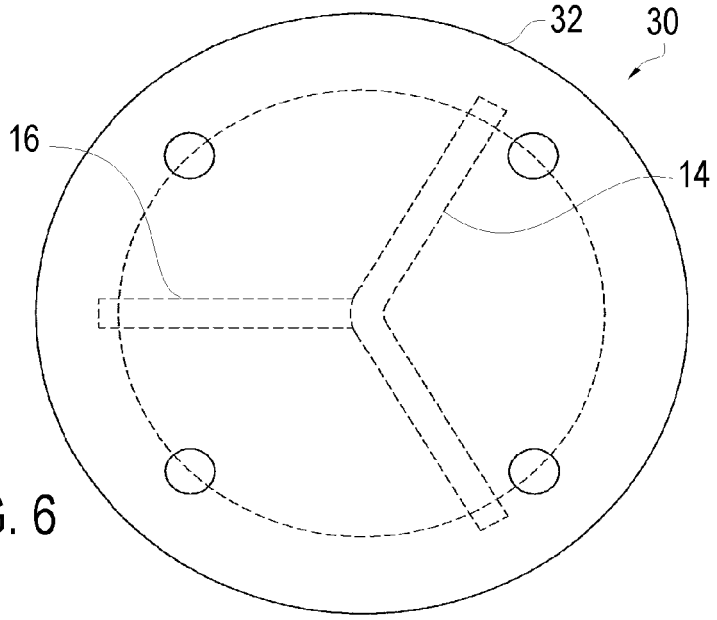
FIG. 6 is a top plan view of the foundation support of FIG. 4A.

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

FIGS. 1-3 illustrate a flat plate foundation support 10, or anchor 10, for supporting and anchoring a ground supported structure according to an embodiment of the present invention. The foundation support 10 extends longitudinally along a central longitudinal axis. A lower portion of the support is adapted to be inserted into a ground surface below the grade 12. The lower portion of the support 10 includes a plurality of flat plates 14 and 16 that are mutually connected along the central longitudinal axis.

As shown in FIGS. 2 and 3, the lower portion is made up of two flat plates 14 and 16, a longer first plate 14 that is bent at an angle in the middle and a second flat plate 16 that is attached to the first plate 14 at the apex angle by a suitable method, such as welding. Each side of the single bent plate 14 forms a "flat" plate 14 extending radially from the center axis. Accordingly, the lower portion of the foundation support 10 is made up of three longitudinal fins (14 and 16) that extend laterally or radially from the central longitudinal axis (corresponding to the apex of the angle of the bent flat plate) and are equally spaced at angles of 120°. It is to be appreciated that the lower portion of the foundation support 10 may be of a variety of different configurations of flat plates having two or more fins.

As shown in FIG. 1A, the flat plates 14 and 16 making up the lower portion of the foundation support 10 are beveled at an angle of 60° at the lower end and as shown in FIG. 1B have sharpened leading edges to facilitate placement of the foundation support 10 into the ground surface 12.

With further reference to FIG. 1, an upper portion of the foundation support 10 is provided for connecting to and supporting the ground supported structure. As shown, the upper portion is a cylindrical pipe 18 that is disposed over a top end of the lower portion so that the upper and lower portions are co-extensive along the central longitudinal axis for a certain length, such as 6 inches shown at 20. An inner surface of the cylindrical pipe 18 is connected to the lateral edges of the flat plates 14 and 16 by a suitable method, such as welding along the lateral edges of the fins in the longitudinal direction.

It is to be appreciated that the foundation support 10 may be of any longitudinal length and the upper and lower portions may be of varying relative longitudinal lengths depending on the conditions of use. Additionally, the flat plates 14 and 16 may also be of varying thickness and lateral lengths extending from the central longitudinal axis and the diameter of the cylindrical pipe of the upper portion may be of a corresponding diameter depending on the conditions of use.

It is also to be appreciated that individual foundation supports may be pre-assembled and then shipped to a construction site for installation. In particular, the individual foundation supports 10 may be inserted into the ground surface individually by using a vibrator or push-it machine to apply vibration to the lower portion of the foundation support 10 while pushing downward on the top end in order to insert the foundation support into the ground 12 beginning with the beveled lower end. It is also to be appreciated that, depending on the application and conditions of the ground surface 12, the foundation support 10 may be inserted into the ground surface 12 without the necessity of pre-drilling a hole in the ground surface 12. Alternatively, the foundation support 10 may be installed in a pre-drilled hole depending on the conditions of the ground surface 12. Additionally, use of the foundation support 10 according to this embodiment substantially eliminates the need for backfilling of soil and/or concrete to complete the foundation, thus saving substantial construction time and costs. A ground supported structure may then be attached to the top of the cylindrical pipe. In operation, one or more foundation supports 10 may be provided to support a single structure.

Figure 7:
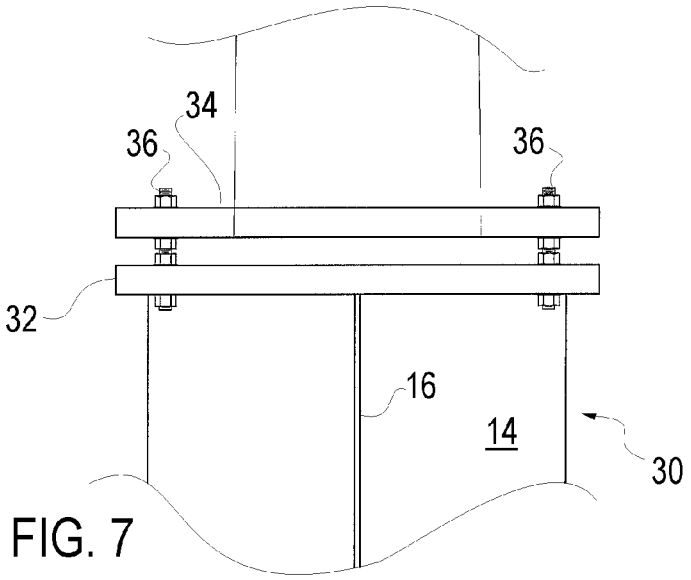
FIG. 7 is a detailed side view of the foundation support of FIG. 4A, illustrating a connection between the foundation support and a ground supported structure.

FIGS. 4-7 illustrate a flat plate foundation support 30, or anchor 30 according to another embodiment of the present invention. As shown, the lower portion of the foundation support 30 is substantially the same as the embodiment of support 10 discussed above with reference to FIGS. 1-3. The upper portion is distinct and comprises a top plate 32 that is disposed on the top end of the lower portion such that the top plate 32 extends across the top edges of the flat plates 14 and 16 of the lower portion, which are disposed flush with the ground surface 12 such that the top plate 32 is disposed on or near the ground surface 12. A ground supported structure is then attached to the top plate. Typically, the ground supported structure will include a mounting plate 34 having a corresponding structure to the top plate 32 of the support foundation 30. The two plates 32 and 34 may then be connected by known methods, such as bolt fasteners 36, as best shown in FIG. 7.

Figure 8A:
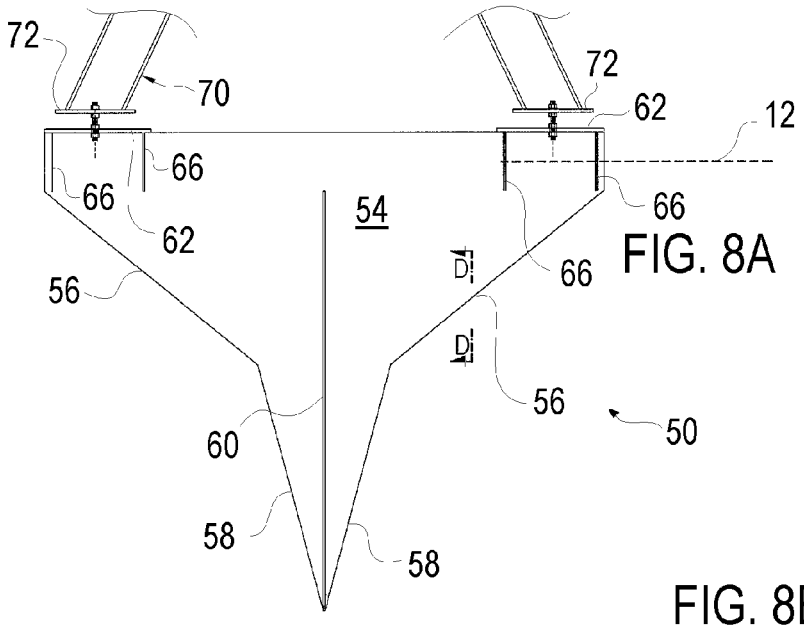
FIG. 8A is a front side view of a flat plate foundation support according to another embodiment of the present invention.
Figure 8B:
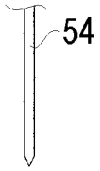
FIG. 8B is an enlarged side view of a single fin of the flat plate foundation support shown in FIG. 8A taken along lines D-D of FIG. 8A.
Figure 9:
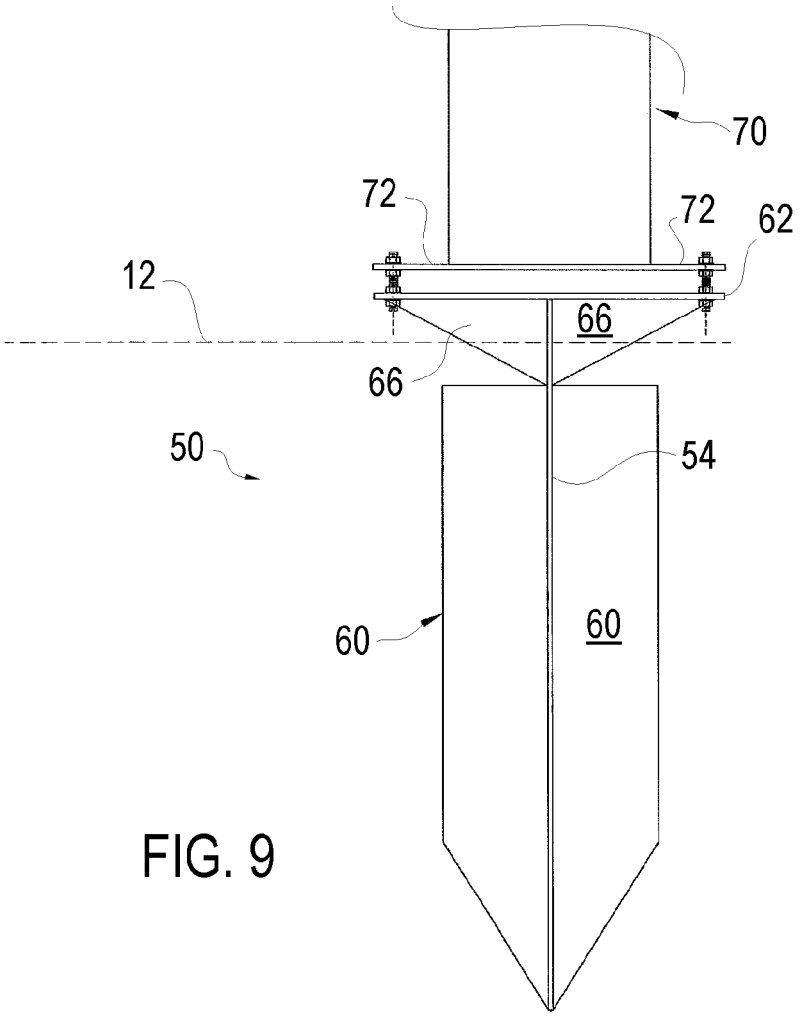
FIG. 9 is a left side view of the flat plate foundation of FIG. 8A.

FIGS. 8-11 illustrate another flat plate foundation support 50, or anchor according to an embodiment of the present invention. As shown in FIGS. 8-10, the lower portion of the foundation support 50 includes an elongated flat plate 54 having two beveled portions. A center portion of the elongated plate 54 is beveled at 56, with respect to the longitudinal axis of the lower portion, at a relatively shallow angle. A bottom portion of the plate 54 is more sharply beveled at 58 with respect to the longitudinal axis. The leading edges of both the center and bottom portions of the elongated plate are sharpened.

The lower portion of the foundation support 50 also includes a pair of side plates 60, or side fins 60, disposed on opposing sides of the elongated plate 54 and connected to the elongated plate 54 along the central longitudinal axis by a known method, such as welding of the plates 60 along the central longitudinal axis. The lower ends of the side plates 60 are also beveled and include sharpened leading edges. It is to be appreciated that the beveled portions and sharpened edges are provided to facilitate the installation of the lower portion of the foundation support 50 without the necessity of pre-drilling or digging of a hole in the ground surface. The length of the side plates 60 along the central longitudinal axis is shorter than the length of the elongated plate 54, such that the side plates 60 are buried in the ground surface 12, while the top end of the elongated plate 54 extends above the ground surface 12.

Figure 11:
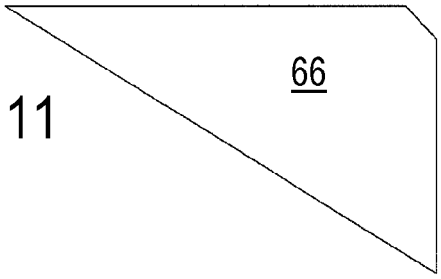
FIG. 11 is a detailed view of a gusset plate for use in the flat plate foundation support of FIG. 8.

As shown in FIGS. 8-10, the upper portion of the support includes a pair of support plates 62 disposed on top of opposing lateral ends of the elongated plate 54. As shown in FIG. 10, the support plates 62 include adjustable mounting holes 64, shown in detail in enlarged view of FIG. 10A, to facilitate attachment of varying configuration of mounting plates of the ground supported structure. Each support plate 62 may additionally be supported by one or more triangular gussets 66 (four are shown for each plate 62) extending between the elongated plate 54 and the support plate 62, as shown in FIGS. 9 and 11. One structure, such as an A-frame structure 70 shown in FIG. 8, or plural ground supported structures may be anchored by a single foundation support 50 according this embodiment. In particular, each of the legs of the A-frame structure 70 shown in FIG. 8 includes a mounting plate 72 attached to the top plate 62 of the foundation support 50 by one or more fasteners. The A-frame structure supports a solar collector array.

It is to be appreciated that the foundation support 50 shown in FIGS. 8-11 may be of any longitudinal length and the elongated and side plates 54 and 60 may be of varying lateral widths extending from the central longitudinal axis. Additionally, the top plates 62 may also be of varying thickness depending on the conditions of use.

It is also to be appreciated that individual foundation supports 50 may be pre-assembled and then shipped to a construction site for installation. In particular, the individual foundation supports 50 may be inserted into the ground surface individually by using a vibrator or push-it machine to apply vibration to the foundation support 50 while pushing downward on the top end in order to insert the foundation support 50 into the ground 12 beginning with the beveled lower end 58. It is also to be appreciated that, depending on the application and conditions of the ground surface 12, the foundation support 50 may be inserted into the ground surface 12 without the necessity of pre-drilling a hole in the ground surface 12. Alternatively, the foundation support 50 may be installed in a pre-drilled hole depending on the conditions of the ground surface. Additionally, use of the foundation support 50 according to this embodiment eliminates the need for backfilling of soil and/or concrete to complete the foundation, thus saving substantial construction time and costs. A ground supported structure, such as 70, may then be attached to the top plates 62 at the lateral ends of the elongated plate 54, as discussed above.

It is to be appreciated that the above-described embodiments of a flat plate foundation supports 10, 30 and 50 may be manufactured according to any technique known to be suitable to those having ordinary skill in the art and may be made from any material known to be suitable to those having ordinary skill in the art. According to one embodiment of the present invention, the flat plate foundation supports 10, 30 and/or 50 are made from steel and individual steel pieces of the foundation support are connected by welding and are pre-assembled and shipped to a construction site ready for installation.

According to another embodiment of the present invention, the flat plate foundation supports 10, 30 and/or 50 may be installed by a metal foundation push-it and installation apparatus of the type disclosed in U.S. Pat. Nos. 5,660,504, 5,733,068, and 5,944,452, all of which are incorporated herein by reference.

While several embodiments of a flat plate foundation support were described in the foregoing detailed description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are embraced within their scope.

What is claimed is:

1. A flat-plate foundation support including:

a lower portion extending longitudinally along a central longitudinal axis of the support and adapted for insertion into a ground surface, wherein the lower portion has a plurality of flat plates that are mutually connected along the central longitudinal axis of the support and extend radially from the central longitudinal axis, and wherein the flat plates are beveled and have a sharpened leading edge at a lower end of the lower portion, wherein one of the flat plates of the lower portion of the support includes an elongated plate having a length and comprising:

i) a center portion that is beveled, with respect to the longitudinal axis of the lower portion, and ii) a bottom portion that is beveled more sharply than the center portion, with respect to the longitudinal axis, wherein two of the flat plates of the lower portion each include a pair of side plates, each of the side plates having a length and disposed on opposing sides of the elongated plate and connected to the elongated plate along the central longitudinal axis, and wherein the length of each of the side plates along the central longitudinal axis is shorter than the length of the elongated plate; and an upper portion of the support is attached to a top end of the lower portion, wherein the upper portion of the support is configured to be attached to an apparatus supported by the ground surface to anchor the apparatus to the ground surface.

2. The flat-plate foundation support according to claim 1 wherein the leading edge of both the center portion and the bottom portion of the elongated plate are sharpened.

3. The flat-plate foundation support according to claim 1 wherein the upper portion of the support includes a pair of support plates disposed on top of opposing lateral ends of the elongated plate.

4. The flat-plate foundation support according to claim 3 wherein the support plates are additionally supported by at least one triangular gusset extending between the elongated plate and a respective one of the support plates.

5. A flat-plate foundation support including:

a lower portion extending longitudinally along a central longitudinal axis of the support and adapted for insertion into a ground surface, wherein the lower portion has three flat plates that are mutually connected along the central longitudinal axis of the support and extend radially from the central longitudinal axis and are equally spaced at angles of 120 degrees, and wherein each of the flat plates are beveled and have a sharpened leading edge at a lower end of the lower portion;

an upper portion of the support is attached to a top end of the lower portion, wherein the upper portion of the support is configured to be attached to an apparatus supported by the ground surface to anchor the apparatus to the ground surface; and wherein the upper portion includes a cylindrical pipe disposed over a top end of the lower portion and having an inner surface attached to each of the flat plates, and wherein the inner surface of the pipe is welded to a radial end of each of the flat plates.

6. A flat-plate foundation support including:

a lower portion extending longitudinally along a central longitudinal axis of the support and adapted for insertion into a ground surface, wherein the lower portion has a plurality of flat plates that are mutually connected along the central longitudinal axis of the support and extend radially from the central longitudinal axis, and wherein each of the flat plates are beveled and have a sharpened leading edge at a lower end of the lower portion, wherein one of the flat plates of the lower portion of the support includes an elongated plate having a length and comprising:

i) a center portion that is beveled, with respect to the longitudinal axis of the lower portion, and ii) a bottom portion that is beveled more sharply than the center portion, with respect to the longitudinal axis; and an upper portion of the support is attached to a top end of the lower portion, wherein the upper portion of the support is configured to be attached to an apparatus supported by the ground surface to anchor the apparatus to the ground surface, wherein the upper portion of the support includes a pair of support plates disposed on top of opposing lateral ends of the elongated plate, and wherein the support plates are additionally supported by at least one triangular gusset extending between the elongated plate and a respective one of the support plates.

7. The flat-plate foundation support according to claim 6 wherein each of the flat plates of the lower portion further includes a pair of side plates disposed on opposing sides of the elongated plate and connected to the elongated plate along the central longitudinal axis.

8. The flat-plate foundation support according to claim 7 wherein the lower end of each of the side plates is beveled and includes a sharpened leading edge.

9. The flat-plate foundation support according to claim 7 wherein each of the side plates has a length along the central longitudinal axis that is shorter than the length of the elongated plate.

* * * * *